United States Patent [19]

Sakaguchi et al.

[11] Patent Number: 4,506,001

[45] Date of Patent: Mar. 19, 1985

[54] PHOTOGRAPHIC RECORDING MATERIAL CONTAINING NOVEL COORDINATION POLYMER

[75] Inventors: Shinji Sakaguchi; Hisashi Okamura; Shigeru Nakamura, all of Kanagawa, Japan

[73] Assignee: Fuji Photo Film Co., Ltd., Kanagawa, Japan

[21] Appl. No.: 595,632

[22] Filed: Apr. 3, 1984

Related U.S. Application Data

[63] Continuation of Ser. No. 379,697, May 19, 1982, abandoned.

[30] Foreign Application Priority Data

May 19, 1981 [JP] Japan ..... 56/75269

[51] Int. Cl.[3] ..... G03C 1/40; G03C 5/54

[52] U.S. Cl. ..... 430/213; 430/215; 430/222; 430/941

[58] Field of Search ..... 430/213, 215, 222, 223, 430/224, 225, 261, 941

[56] References Cited

U.S. PATENT DOCUMENTS

| | | | |
|---|---|---|---|
| 3,081,167 | 3/1963 | Goulston et al. | 430/222 |
| 3,196,014 | 7/1965 | Rogers | 430/225 |
| 4,142,891 | 3/1979 | Baigrie et al. | 430/222 |
| 4,239,847 | 12/1980 | Archie et al. | 430/213 |
| 4,383,021 | 5/1983 | Bergthaller et al. | 430/213 |

*Primary Examiner*—Richard L. Schilling

*Attorney, Agent, or Firm*—Sughrue, Mion, Zinn, Macpeak and Seas

[57] ABSTRACT

A photographic recording material is disclosed. The material is comprised of a transparent support base and a number of layers positioned on that base. A dye ligand or a dye ligand-forming substance is positioned on the base and is associated with a light-sensitive silver halide emulsion. In addition, the material contains a mordant layer, an alkaline processing composition, and a means for releasing the composition throughout the photographic recording material in an integrated manner or as a different system. The mordant layer contains a coordination polymer composed of a ligand represented by a general formula (I) defined within the application and a metal ion. The invention makes it possible to immobilize a metal ion using inexpensive, easily available metal-chelatable ligands.

16 Claims, No Drawings

PHOTOGRAPHIC RECORDING MATERIAL CONTAINING NOVEL COORDINATION POLYMER

This application is a continuation of application Ser. No. 379,697, filed May 19, 1982, now abandoned.

BACKGROUND OF THE INVENTION

This invention relates to a photographic recording material and, more particularly, to a photographic recording process for forming a metal-chelated dye within an image-receiving layer using a dye ligand or a dye ligand-forming substance capable of forming a metal chelate, which process comprises fixedly incorporating a metal in the image-receiving layer of the photographic recording material.

The use of a dye or a dye-forming substance in a photographic recording material, and in particular in a diffusion transfer process photographic recording material is known. With such photographic materials, stability of the formed dye image, particularly, resistance to light, is one of the serious subjects. The use of a metal-chelatable dye for improving resistance of the dye image to light is also known. Examples of using metal-chelatable dyes are described in, for example, U.S. Pat. No. 3,196,014. In diffusion transfer process photography, the diffusing speed of the metal-chelatable dye becomes very slow due to the huge molecular weight of the metal-chelated dye. Accordingly, the appearance of an image after imagewise exposure and development processing is often delayed. Therefore, formation of the complete image requires a substantially long period of time. In order to remove such disadvantage, U.S. Pat. No. 4,239,847 discloses a process for forming a metal-chelated dye by immobilizing a metal within an image-receiving layer with a polymer ligand. The process uses an unchelated, chelatable dye ligand or dye ligand-forming substance, and causes a ligand exchange reaction between the metal complex of the polymer ligand and the dye ligand within the image-receiving layer. However, the use of a chelatable polymer ligand for immobilizing metal causes a change in viscosity of a coating solution of the polymer-containing layer depending upon the viscosity of the polymer. Therefore, it becomes difficult to obtain a photographic recording material having an accurate and uniform film thickness. Furthermore, when using a cationic polymer as a mordant and an anionic polymer as a polymer ligand, an insoluble polyion complex is produced to form agglomerates (called seeding) inconvenient for obtaining smooth coating. Therefore, they cannot be coated as one layer. In order to avoid this seeding, it has been proposed to coat the cationic polymer mordant and the polymer ligand as different layers. In this case, a polyion complex is still formed at the interface between the two layers to cause visual turbidity (called haze). Accordingly, the commercial value of the material is deteriorated. In addition, providing different layers increases the distance between the dye ligand or dye ligand-forming substance-containing layer and the mordant layer for immobilizing imagewise released dye. This prolongs the time necessary for the completion of image after imagewise exposure and development processing, thus seriously deteriorating the commercial value of the photographic recording material because products capable of providing an image in as short a time as possible are demanded.

Examples of processes for producing the polymer ligands include a process involving the reaction between a polymer having a reactive group and a low molecular compound having a coordinating group (so-called high molecular reaction) as described in U.S. Pat. No. 4,239,847, *Functional Polymers*, compiled by Kobunshi Gakkai and published by Koritsu Shuppan, p. 34–36 (Tokyo, 1974), and a process involving synthesizing a monomer having a coordinating group, and polymerizing the resulting monomer (so-called monomer process) as described in U.S. Pat. No. 4,239,847, *Functional Polymers* cited above p. 36–38.

In the former high molecular reaction, reactivity is generally less than that in reactions between low molecular compounds. Therefore, the ratio of introducing coordinating groups into the high polymers is so low that only a polymer ligand with poor quality is obtained.

In the latter monomer process, the monomer has a polymerizable group due to its essential properties. During the reaction step of introducing a coordinating group into the monomer, undesirable reactions of the polymerizable group often take place. This causes difficulties in the reaction procedure such as damaging a reactor, deterioration of washability of a reactor. These difficulties result in reducing the yield of the monomer having a coordinating group, resulting in deterioration of productivity and economical properties.

In the process of producing a metal-chelated dye within an image-receiving layer using a previously non-chelated dye ligand or dye ligand-forming substance, a metal ion coated as an image-receiving layer tends to diffuse into other layers. When it reaches a light-sensitive emulsion layer, it creates harmful photographic properties. Even when it does not reach a light-sensitive emulsion layer, dispersion of the metal ion in several layers between a mordant layer and a light-sensitive emulsion layer leads to formation of a metal-chelated dye before a dye ligand released by imagewise exposure and subsequent development reaches the mordant layer. This results in an undesirable increase in image-transferring time or a reduction in image density. In order to prevent this harmful function, the metal ion must be securely immobilized in a specific layer within an image-receiving layer. However, when a dye ligand is released by imagewise exposure and subsequent development and reaches the image-receiving layer, the immobilized metal ion must react with the dye ligand to cause a ligand exchange reaction.

SUMMARY OF THE INVENTION

It is, therefore, an object of the present invention to provide a process for immobilizing a metal ion using an inexpensive, easily available metal-chelatable ligand.

Another object of the present invention is to provide a photographic recording material having a metal ion-immobilizing layer which decreases coating troubles such as seeding trouble, streaking, etc., upon coating.

A further object of the present invention is to provide a photographic recording material having a metal-immobilizing layer which can securely immobilize a metal ion and which undergoes a rapid ligand exchange reaction with a dye ligand, and a system thereof.

Still a further object of the present invention is to provide a diffusion transfer process photographic recording material which shows a rapid image-transferring rate and provides improved stability of a dye image such as resistance to light.

As a result of extensive investigations, the inventors have found that the above-described objects can be attained by the photographic recording material obtained by the following process. That is, the photographic recording material of the present invention comprises a dye ligand- or dye ligand-forming substance-containing layer associated with a light-sensitive silver halide emulsion layer, a mordant-containing layer (abbreviated as "mordant layer" in this specification), an alkaline processing composition, and a means for releasing the composition into the inside of photographic recording material, in an integrated manner or as a different system, said mordant layer or a layer in a close proximity to the mordant layer containing a coordinate polymer composed of a ligand represented by the following general formula (I) and a metal ion:

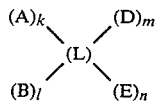

wherein A, B, D and E each represents a coordinating group, L represents a single bond or a linking group containing 1 to 30 carbon atoms and having a valency of (k+l+m+n), provided that when all of the coordinating groups represent only

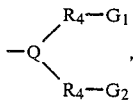

L does not represent a chain hydrocarbon residue containing 1 to 3 carbon atoms, and k, l, m and n each represents an integer of 0 to 6, with k+l+m+n being 2 to 10.

DETAILED DESCRIPTION OF THE INVENTION

More specifically, the coordinating groups represented by A, B, D and E in general formula (I) are respectively groups capable of forming a coordination bond with a specific metal ion, and are represented by

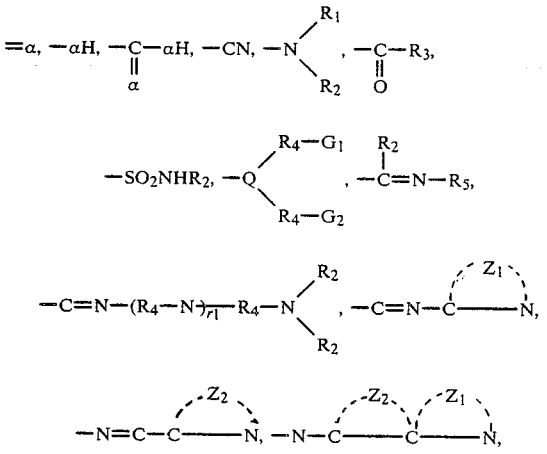

-continued

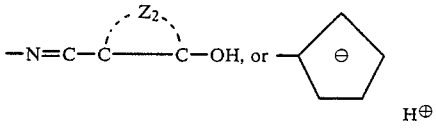

wherein $\alpha$ represents O or S, $R_1$ represents $R_2$ or —CONH—$R_2$, —$SO_2R_6$ or —$SO_2NHR_6$, $R_2$ represents a hydrogen atom or an alkyl group containing 1 to 6 carbon atoms, $R_3$ represents $R_2$ or —$CH_2COR_5$, $R_4$ represents an alkylene group containing 1 to 4 carbon atoms, $R_5$ represents —OH or $R_6$, $R_6$ represents an alkyl group containing 1 to 6 carbon atoms or an aryl group containing 6 to 10 carbon atoms, Q represents N, P or As, $G_1$ and $G_2$ each represents

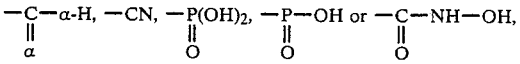

$r_1$ represents an integer of 0 to 4, $Z_1$ represents atoms necessary for forming at least one 5- to 7-membered hetero ring (for example, pyridine, imidazole, pyrrole, pyrimidine, indole, quinoline, purine, oxazole, or the like), and $Z_2$ represents $Z_1$ or atoms necessary for forming at least one 5- to 7-membered carbon ring (for example, benzene, indene, pentalene, naphthalene, anthracene, or the like).

When the coordinating groups can form a salt, they may be in the form of salts (for example, alkali metal salts, quaternary ammonium salts, and acid salts such as hydrochlorides and sulfates with amino group). In addition, they may be in the form of hydrolyzable precursors (for example, a sulfamoyl group, —$OCOR_7$, —$OCOOR_7$, —$OCON(R_7)_2$, and —$COOR_7$ (wherein $R_7$ represents an alkyl group containing 1 to 6 carbon atoms, or an aryl group containing 6 to 10 carbon atoms)).

Of these coordinating groups,

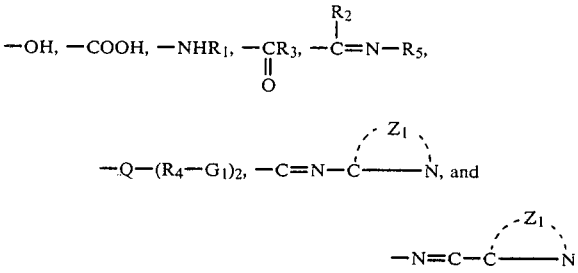

are preferable, with —OH, —COOH, —$NH_2$, and —$N(CH_2—G_1)_2$ being particularly preferable.

L is a linking group for the coordinating groups represented by A, B, D and E and includes a single bond, a chain or alicyclic hydrocarbon residue containing 1 to 30 carbon atoms (for example, a methylene group, an ethylene group, a hexane residue, a cyclohexane residue, or the like), an aromatic hydrocarbon or hetero ring residue containing 3 to 26 carbon atoms (for example, phenyl, biphenyl, naphthalene, anthracene, fluorene, benzimidazole, pyridine, pyrimidine, indole, quinoline, pyrazine, dipyridyl, quinoxaline, phenanthroline residue, or the like), $-(CH_2)_{r2}Z_3-$, $-(CH_2)_{r2}-Z_3-(CH_2)_{r2}$, $-(CH_2)_{r3}Z_3-(CH_2)_{r2}Z_3-(CH_2)_{r3}$ and $-(CH_2)_{r3}Z_3-Y-Z_3)_{r3}Y-Z_3-(CH_2)_{r3}$ (wherein $Z_3$ represents an aromatic hydrocarbon residue containing 3 to 18 carbon atoms or a hetero ring residue, $r_2$ represents an integer of 1 to 4, $r_3$ represents 0 or $r_2$, Y represents $$-O-,\ -S-,\ -NR_8-,\ -CONR_8-,\ -SO_2NR_8-,\ -COO-,$$

$$-CO-,\ -SO_2-,\ -NHC(=O)-NH-,\ -NHSO_2-NH-\ \text{or}$$

$$-CH=CH-(CH_2)_{r3}-,$$

$R_8$ represents a hydrogen atom or $R_7$ (the same as defined hereinbefore), provided that when all of the coordinating groups are only

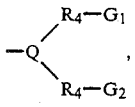

L does not represent a chain hydrocarbon residue containing 1 to 3 carbon atoms.

Of these, L preferably represents an aromatic hydrocarbon residue containing 3 to 18 carbon atoms, a hetero ring residue or $-(CH_2)_{r2}Z_3-(CH_2)_{r2}$ or $-(CH_2)_{r4}Z_3-Y-Z_3-(CH_2)_{r4}$, with phenyl, naphthalene, biphenyl, $-CH_2Z_4-CH_2-$, and $-(CH_2)_{r4}Z_4-Y_2-Z_4-(CH_2)_{r4}$ being particularly preferable wherein $Z_4$ represents phenylene or naphthalene, $Y_2$ represents —O—, —CONH—, $-SO_2NH-$, —CO— or $-SO_2-$, and $r_4$ represents 0 or 1.

k, l, m and n each represents an integer of 0 to 6 and, from the point of synthesis adaptability, they are preferably 0 to 3, with $m=n=0$ and $k+l=2$ to 6 being particularly preferable.

In this specification, "image-receiving layer" may have a mordant layer and a metal ligand-containing layer, or may be a layer containing both a mordant and a metal ligand. As a method for coating the image-receiving layer, the mordant layer, the ligand-containing layer, and the metal ion source-containing layer may be separately coated, or any two of the three members of mordant, ligand, and metal ion source may be coated as a single layer, or the three may be coated as a single layer.

Two or more ligands may, if necessary, be used in combination.

Specific examples of the ligands represented by general formula (I) are as follows.

(I-1)

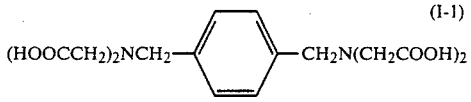

(I-2)

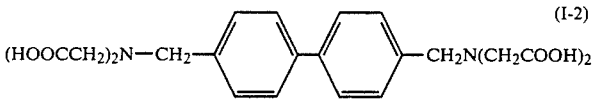

(I-3)

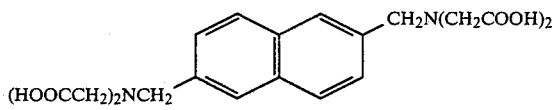

(I-4)

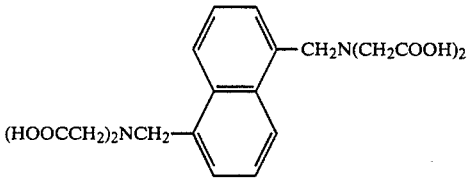

(I-5)

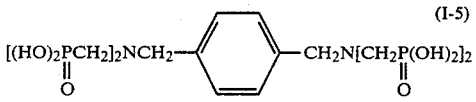

(I-6)

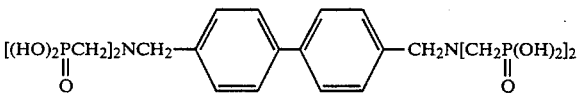

(I-7)

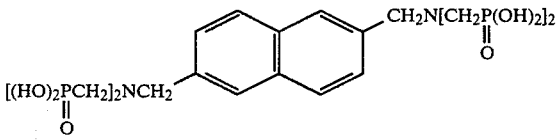

(I-8)

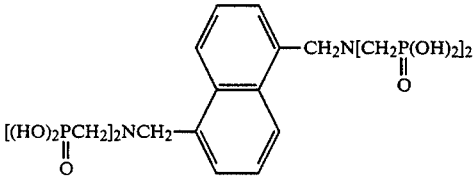

(I-9)

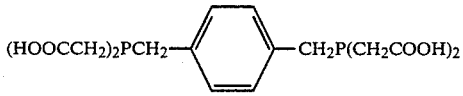

(I-10)

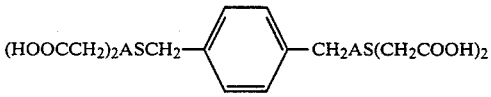

(I-11)

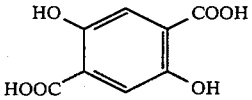

(I-12)

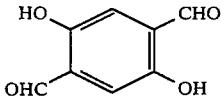

(I-13)

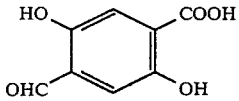

(I-14)

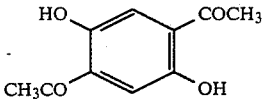

(I-15)

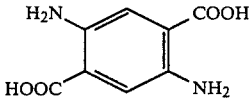

(I-16)

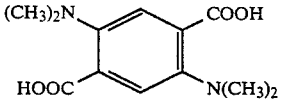

-continued
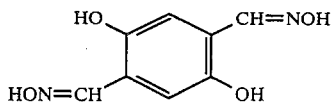
(I-17)
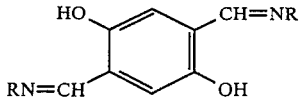
(I-18a, b, c, d)
(a b c d
R: $CH_3$ $C_2H_5$ $C_3H_7$ $C_6H_5$)
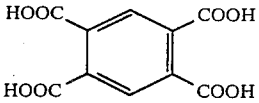
(I-19)
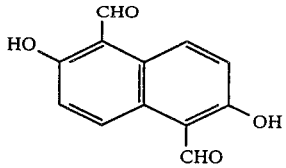
(I-20)
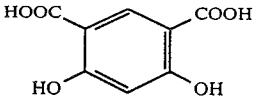
(I-21)
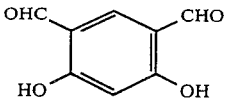
(I-22)
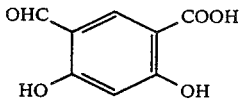
(I-23)
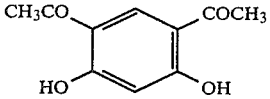
(I-24)
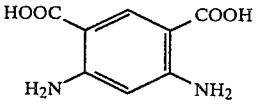
(I-25)
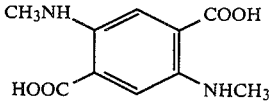
(I-26)
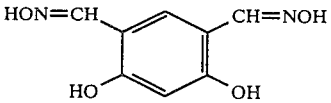
(I-27)
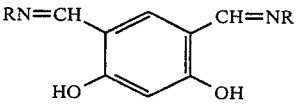
(I-28a, b, c, d)
(a b c d
R: $CH_3$ $C_2H_5$ $C_3H_7$ $C_6H_5$)
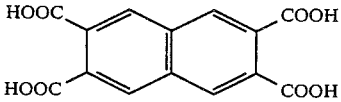
(I-29)
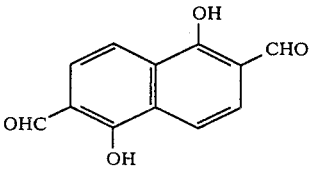
(I-30)
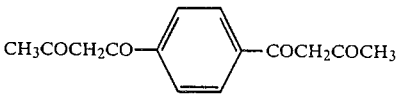
(I-31)
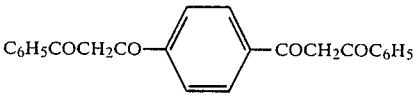
(I-32)
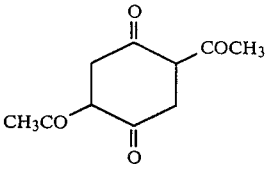
(I-33)
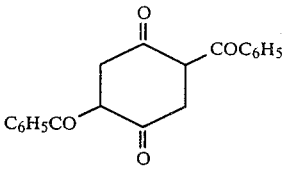
(I-34)
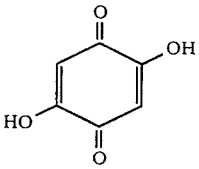
(I-35)
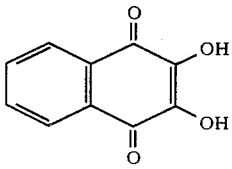
(I-36)
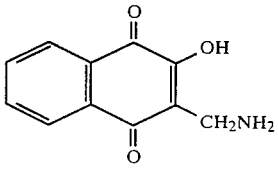
(I-37)
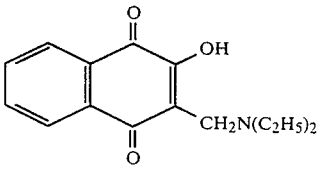
(I-38)
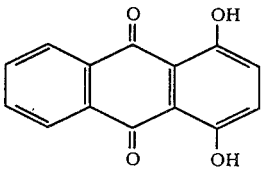
(I-39)
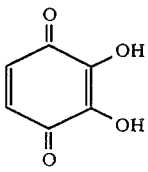
(I-40)
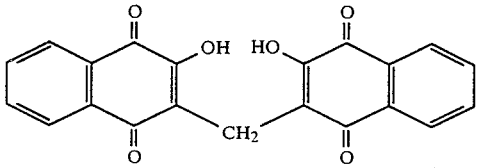
(I-41)

-continued
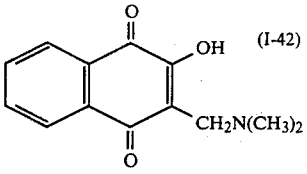
(I-42)
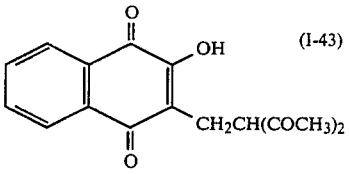
(I-43)
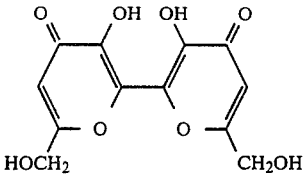
(I-44)
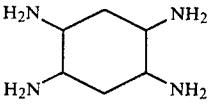
(I-45)
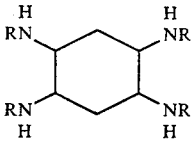
(I-46a, b)
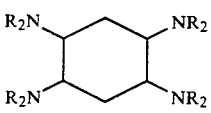
(I-47a, b)
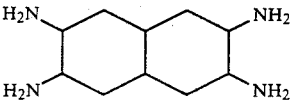
(I-48)
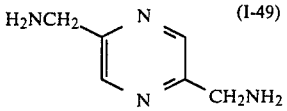
(I-49)
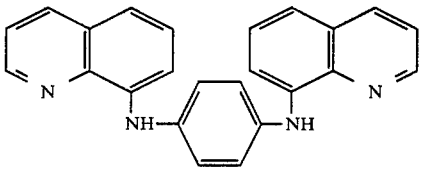
(I-50)
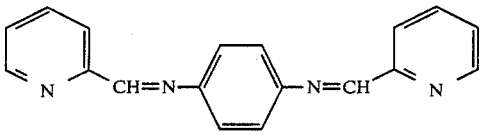
(I-51)
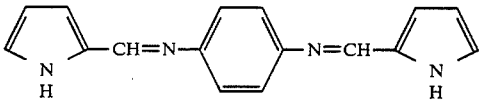
(I-52)
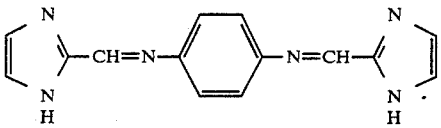
(I-53)
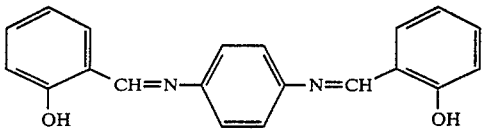
(I-54)
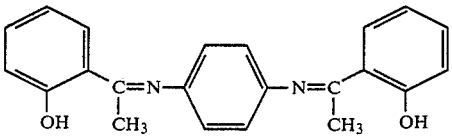
(I-55)
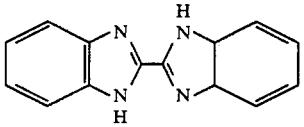
(I-56)
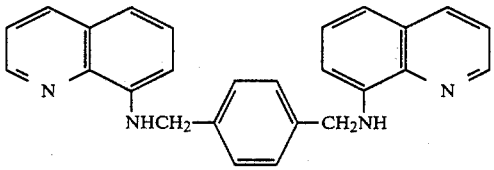
(I-57)
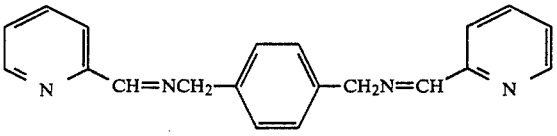
(I-58)
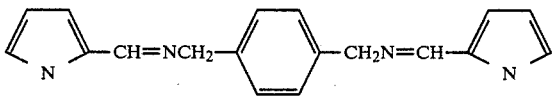
(I-59)
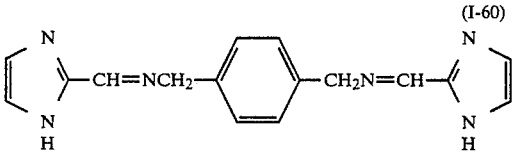
(I-60)
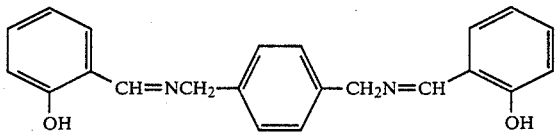
(I-61)
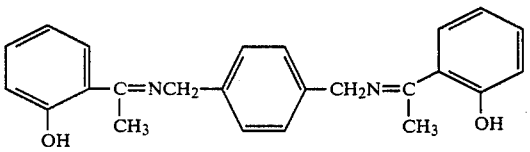
(I-62)

-continued
(I-63)
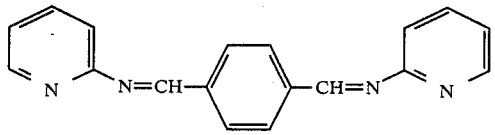
(I-64)
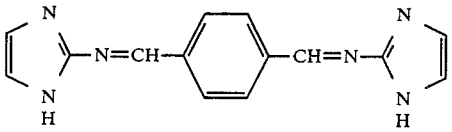
(I-65)
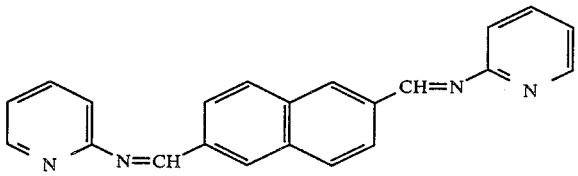
(I-66)
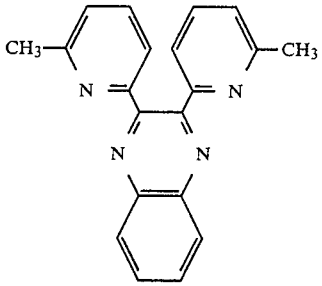
(I-67)
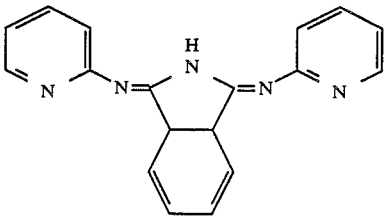
(I-68)
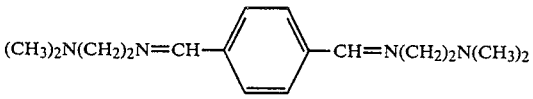
(I-69)
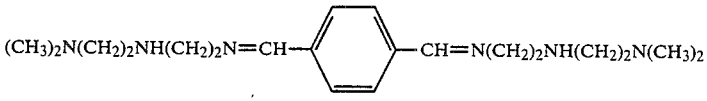
(I-70)
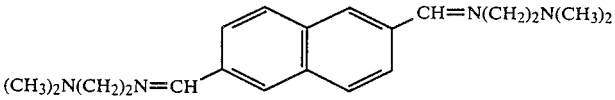
(I-71)
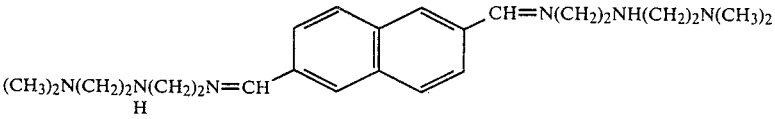
(I-72)
$(HOOCCH_2)_2N-(CH_2)_n-N(CH_2COOH)_2$
$(n \geqq 4)$
(I-73)
$[(HO)_2\overset{\overset{O}{\|}}{P}CH_2]_2N-(CH_2)_n-N[CH_2\overset{\overset{O}{\|}}{P}(OH)_2]_2$
$(n \geqq 4)$
(I-74)
$(HOOCCH_2)_2P-(CH_2)_n-P(CH_2COOH)_2$
$(n \geqq 4)$
(I-75)
$(HOOCCH_2)_2As-(CH_2)_n-As(CH_2COOH)_2$
$(n \geqq 4)$
(I-76)
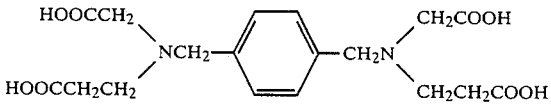
(I-77)
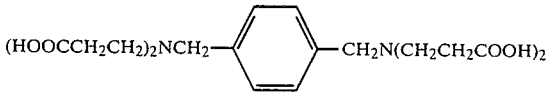
(I-78)
$HOOC-(CH_2)_n-COOH$
$(n = 0, 2 \sim 10)$
(I-79)
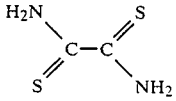
(I-80)
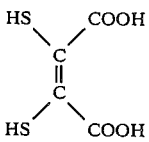
(I-81, b, c)
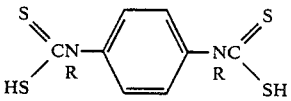
(a b c
R: H, $CH_3$, $C_2H_5$)
(I-82)
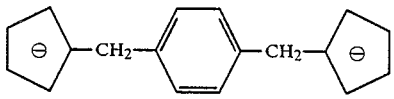

-continued

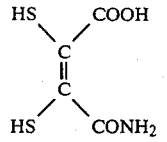
(I-83)

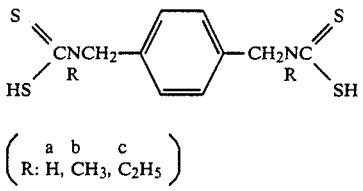
(I-84a, b, c)

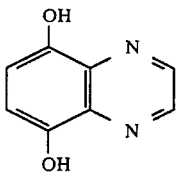
(I-85)

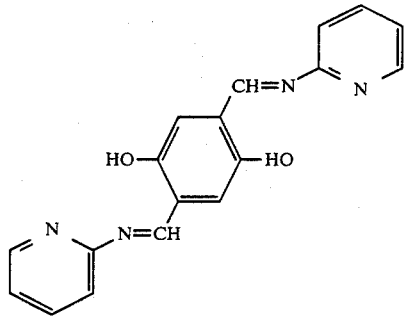
(I-86)

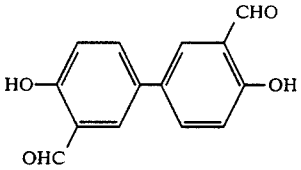
(I-87)

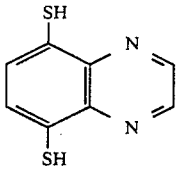
(I-88)

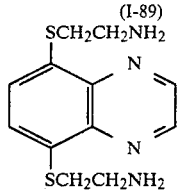
(I-89)

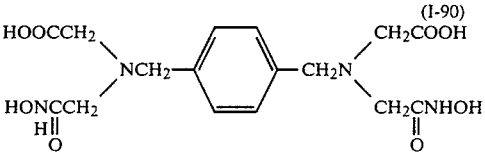
(I-90)

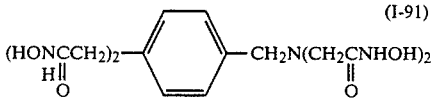
(I-91)

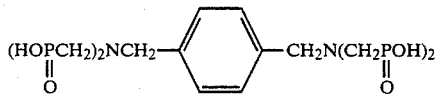
(I-92)

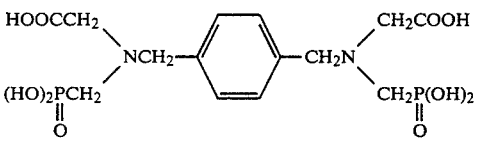
(I-93)

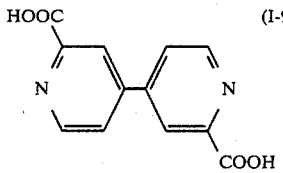
(I-94)

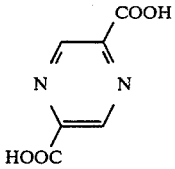
(I-95)

Of these compounds, compounds I-1 to -8, I-76, I-77, and I-90 to -93 are particularly preferred.

Compounds represented by foregoing general formula (I) are known by the following literatures, and several synthesis examples thereof are shown below:

G. Manecke, W. E. Wille, *Makromol. Chem.*, 133, 61 (1970);

G. Manecke, W. E. Wille, and G. Kossmehl, *Makromol. Chem.*, 160, 111 (1972);

E. A. Tomic, *J. Appl. Polymer Sci.*, 9, 3745 (1965);

*Functional Polymers*, compiled by Kobunshi Gakkai and published by Kyoritsu Shuppan, p. 183 (Tokyo, 1974); and Hidetoshi Tsuchida, *Science of High Polymer*, p. 159 (published by Baifukan, Tokyo, 1975).

SYNTHESIS EXAMPLE 1

Synthesis of 1,4-bis(N,N-dimethoxycarbonylmethylamino)methylbenzene

To a solution of $\alpha,\alpha'$-dichloro-p-xylene (87.5 g, 0.5 mol) in acetonitrile (300 ml) was added dimethyl iminodiacetate (328.7 g, 2.04 mols), and stirred at 65° to 70° C. for 8 hours. 250 ml of acetonitrile was added thereto, and crystals formed were removed by filtration, followed by concentrating the solution. After dissolving the residue in 600 ml of ethyl acetate, the solution was washed with water (400 ml×3), then concentrated. Recrystallization of the residue from a hexane-ethyl acetate mixture solvent gave the end product (170.0 g, 80%).

SYNTHESIS EXAMPLE 2

Synthesis of Compound (I-1)

A mixture of 84.9 g (0.2 mol) of the ester obtained in Synthesis Example 1, 48 g (1.2 mols) of sodium hydroxide, 300 ml of water, and 50 ml of methyl ethyl ketone was refluxed for 2 hours under heating. After allowing to cool to room temperature, 100 ml of concentrated hydrochloric acid was added thereto to precipitate crystals of the end product (63.0 g, 86%). m.p. 244° C. (d.)

SYNTHESIS EXAMPLE 3

Synthesis of 1,4-bisbenzoylacetylbenzene [Compound (I-32)]

To a solution of 24.0 g (0.2 mol) of acetophenone and 19.4 g (0.1 mol) of dimethyl terephthalate in 150 ml of ether was dropwise added an ether solution of 0.4 mol of lithium diisopropylamide at −20° C. over 2 hours. After the dropwise addition, the mixture was stirred for 1 hour under cooling with ice, then poured into ice-water. After neutralization with an ammonium chloride aqueous solution, it was extracted with ether, and the extract was dried and concentrated. Recrystallization of the residue from methanol gave 9.5 g (28%) of the title compound. m.p. 175°–177° C.

SYNTHESIS EXAMPLE 4

Synthesis of 5,8-dimethoxyquinoxaline

A mixture of 10 g (0.17 mol) of glyoxal in 50 ml of water was added to 5 g (0.03 mol) of 2,3-diaminohydroquinone dimethyl ether, and stirred at 50° C. for 1 hour. After allowing to cool to room temperature, the reaction solution was extracted with chloroform, and the extract was dried and concentrated. Recrystallization of the residue from benzene gave 4.3 g (75%) of the title compound. m.p. 145°–150° C.

SYNTHESIS EXAMPLE 5

Synthesis of 5,8-dihydroxyquinoxaline [Compound (I-85)]

4 g (0.021 mol) of 5,8-dimethoxyquinoxaline was refluxed for 2 hours under heating in 50 ml of benzene together with 20 g of aluminum chloride. After allowing to cool to room temperature, the reaction solution was extracted with ethyl acetate, and the extract was dried and concentrated. Recrystallization of the residue from ethyl acetate gave 2.4 g (71%) of the end product. m.p. 234°–236° C.

SYNTHESIS EXAMPLE 6

Synthesis of 2,5-dihydroxyterephthalaldehydoxime [Compound (I-17)]

3.3 g (0.02 mol) of 2,5-dihydroxyterephthalaldehyde was added to a solution of 5 g of hydroxyamine hydrochloride and 5 g of sodium acetate in 500 ml of ethanol, and refluxed for 4 hours under heating. After leaving overnight, crystals formed were collected by filtration, and washed with water and methanol successively. Recrystallization of the crystals from dioxane yielded 2.2 g of the end product. m.p. 253°–255° C.

The metal ion to be used in the present invention rapidly reacts with a released dye ligand or dye ligand-forming substance in an image-receiving layer to form a complex having a desired hue, thus forming a metal-chelated dye stable against heat, light, and chemicals. The use of polyvalent metal ion such as copper (II), zinc (II), nickel (II), platinum (II), palladium (II), or cobalt (II) provides good results. If necessary, two or more metal ions may be used in combination. Of these, nickel (II) and copper (II) are particularly preferable.

The coordinate polymer of the present invention obtained from the ligand represented by the general formula (I) and the metal ion is in a chain form, cyclic form or, under specific conditions, three-dimensionally cross-linked network form. The coordinate polymer is not particularly limited as to molecular weight, and those having a molecular weight of from 1,000 to several millions are used. Where the coordinate polymer is insoluble or where it is used together with a mordant, low molecular coordinate polymers having even two to five recurring units as illustrated below:

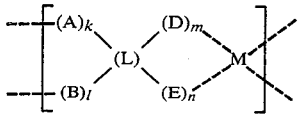

can possess enough metal ion-immobilizing ability to attain the objects of the present invention.

As a source of the metal ion to be used in the present invention, a solution of metal salt such as hydrochloride, sulfate, nitrate, or the like (in, for example, water, methanol, ethanol, dimethylformamide, the mixture thereof, etc.) is preferably used.

In view of immobilization of metal ion in an image-receiving layer and ligand exchange reaction with a dye ligand, stability constant of the metal ion in the coordinate polymer formed by the ligand represented by the general formula (I) and the metal ion is of importance. That is, when the stability constant is too small, the metal ion is not sufficiently immobilized in an image-receiving layer, and part of the metal ion which diffuses into other layers can cause harmful photographic sensitometry results (for example, reduction in sensitivity and density), can provide a metal-chelated product of a dye ligand or dye ligand-forming substance before development processing, or can produce a metal-chelated product of a dye ligand after imagewise exposure and development and before arrival of the dye ligand to a mordant layer, thus causing undesirable delay in image-appearing time and reduction in image density.

On the other hand, difficulties occur when the stability constant is too large. Particularly, when it is larger than the stability constant of a chelate compound between a used dye ligand or dye ligand-forming substance and a metal ion, it makes it difficult for the desired ligand exchange reaction to occur between the dye ligand having reached an image-receiving layer after exposure and development and the coordinate polymer in the image-receiving layer. Due to this problem, the resulting photographic recording materials provide undesirable color hue or undesirable image stability. Thus, stability constant of metal ion in the coordinate polymer to be used in the present invention is $10^8$ to $10^{22}$, preferably about $10^{12}$ to $10^{20}$. The stability constant can be easily determined by reference to, for example, Kagehei Uesugi, Chelate Chemistry (6), pp. 20 to 63 (1975).

The coordinate polymer to be used in the present invention can be used in a mordant layer or a layer in a close proximity thereto (a layer just adjacent to the mordant layer or in proximity to the mordant layer between which one, two or three other layers intervene). Coordinate polymers soluble in a solvent (for example, water, an organic solvent such as methanol, ethanol, acetone, dimethylformamide or ethyl acetate, or the mixture thereof) can be coated without or together with any conventionally used binder. With insoluble coordinate polymers, or even with soluble coordinate polymers, the metal ion source-containing layer and the layer containing ligand represented by the general formula (I) can be provided as different layers. The mordant layer may be provided as a separate layer. In addition, a mordant may be incorporated in a layer containing the ligand represented by the general formula (I) to be coated together. When the metal ion-containing layer and the layer containing the ligand of general formula (I) are provided as different layers, only a few coating difficulties occur (for example, streaking, seeding, haze, etc.) in comparison with the process of using a ligand-containing polymer, because the coordinate polymer is not formed upon coating, thus being particularly preferable.

Since more metal ion is prevented from diffusing into a light-sensitive silver halide emulsion layer, a dye ligand- or dye ligand-forming substance-containing layer, etc., the layer containing ligand of general formula (I) is preferably provided on the side of light-sensitive silver halide emulsion layer with respect to the metal ion source-containing layer.

The proportion of the binder to the coordination polymer of the present invention can be 20 to 0.05, preferably 5 to 0.2. The coordinate polymer is coated in an amount of 0.05 to 20 g/m$^2$, preferably 0.5 to 5 g/m$^2$.

When providing the metal ion-containing layer and the layer containing ligand of general formula (I) as different layers, the ratio of ligand represented by general formula (I) to binder (ligand of general formula (I)/binder) is in the range of from 20 to 0.5, preferably 4 to 0.2. The amount of metal ion to be coated is generally about $10^{-5}$ to about $10^{-1}$ mol/m$^2$.

Examples of binders which may be used in the coordinate polymer layer, metal ion source-containing layer, layer containing ligand of the general formula (I), and the like of a photographic recording material of the present invention include hydrophilic colloids such as gelatin, polyacrylamide, polyvinyl alcohol, polyvinyl pyrrolidone, hydroxyethyl cellulose, copolymers and graft copolymers containing these as major components, etc.

Light-sensitive silver halide emulsions used in the present invention are hydrophilic colloidal dispersions of silver chloride, silver bromide, silver chlorobromide, silver bromoiodide, silver chlorobromoiodide, or mixtures thereof. Halogen composition is properly selected depending upon the end-use and processing conditions of light-sensitive material, with silver bromide, silver bromoiodide or silver chlorobromoiodide containing 10 mol% or less iodide and 30 mol% or less chloride being particularly preferable.

In the present invention, both negative emulsions capable of forming a surface latent image and direct reversal emulsions can be used. Examples of the latter emulsions include internal latent image-forming emulsions and previously fogged direct reversal type emulsions.

In the present invention, internal latent image-forming silver halide emulsions are advantageously used. These types of emulsions include conversion type emulsions, core/shell type emulsions, and foreign metal-incorporated emulsions, described in U.S. Pat. Nos. 2,592,250, 3,206,313, 3,447,927, 3,761,276, 3,935,014, etc.

The silver halide emulsions used in the present invention can have their color sensitivity expanded, if desired, with an optically sensitizing dye. Examples of useful optically sensitizing dyes include cyanine dyes and merocyanine dyes.

Any dye ligands or dye ligand-forming substances can be used as the dye ligand or dye ligand-forming substance to be used in combination with the light-sensitive silver halide emulsion.

In one preferable embodiment, the dye ligand or dye ligand-forming substance is a metal-chelatable dye or dye-forming substance which is described in, for example, U.S. Pat. Nos. 3,081,167, 3,196,014, Belgian Pat. Nos. 905,701 and 1,121,995.

Azo dyes include, for example, dihydroxyazo, pyridylhydroxyazo, aminohydroxyazo, pyridylsulfonamidoazo, and hydroxyisopyridylazo dyes.

Useful dye ligand-forming substances include redox releasers (DRR compounds) containing a dye component having a chelating group. Such dye ligand-forming substances are disclosed in Belgian Pat. No. 858,623.

Examples of "dye ligand-forming substance" useful in the present invention are illustrated below.

(1)

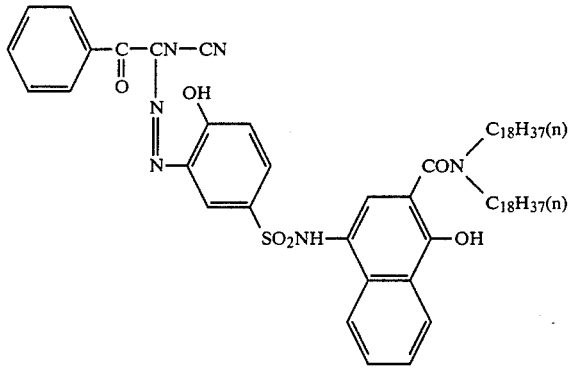

-continued
(2)
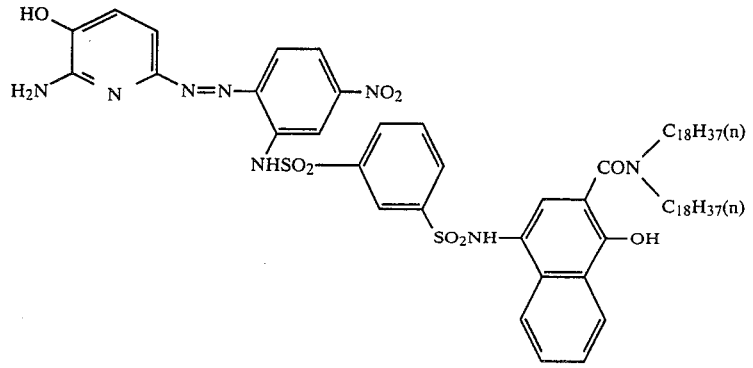
(3)
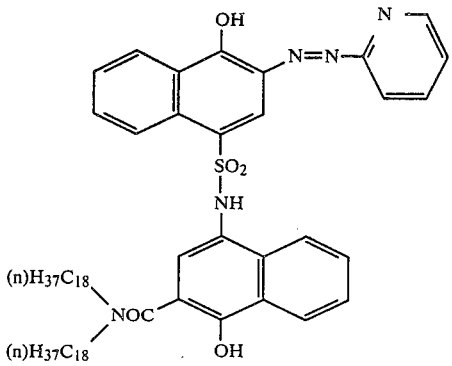
(4)
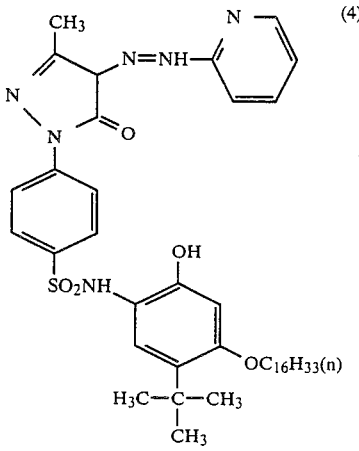
(5)
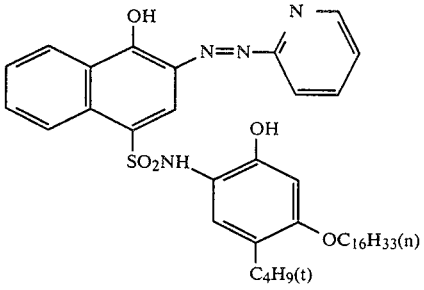
(6)
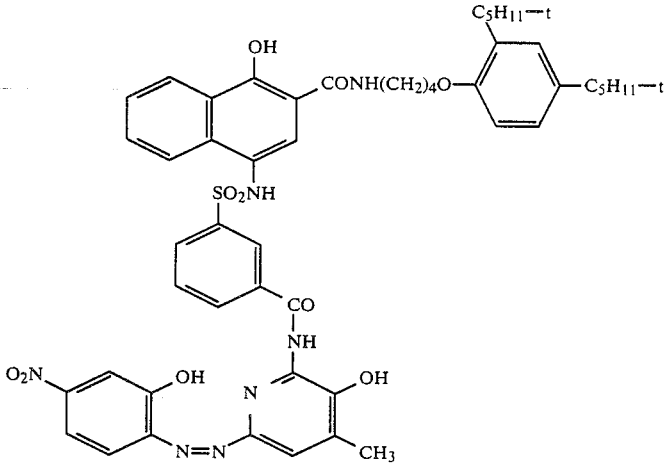

-continued (7)

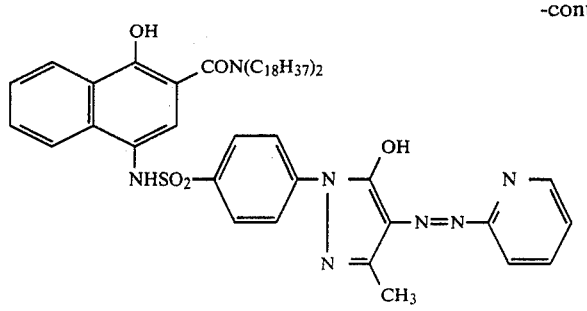

(8)

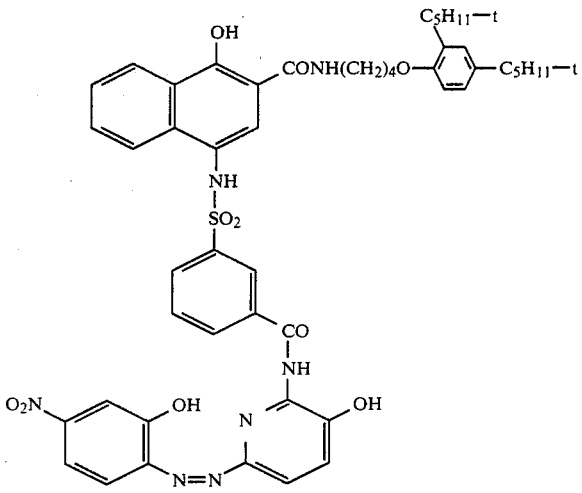

(9)

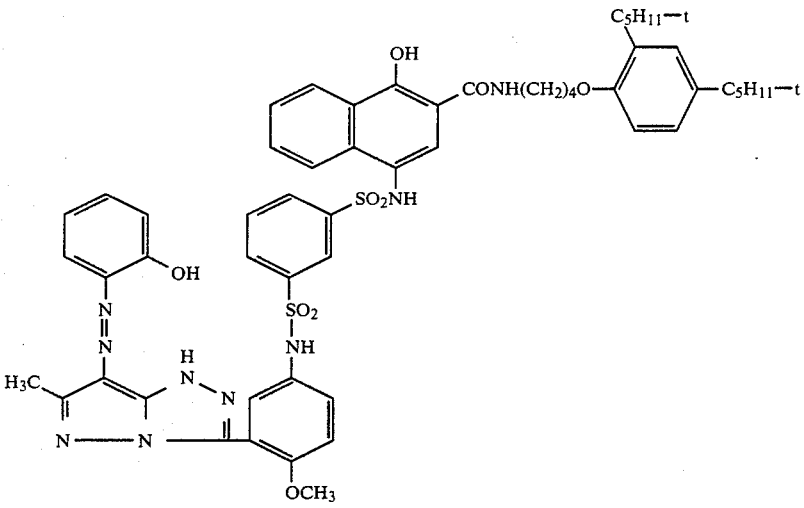

Of these compounds, compounds (4), (6) and (9) are particularly preferred.

When using DRR compounds, any silver halide-developing agent may be used that can cross-oxidize the DRR compounds. Such developing agent may be incorporated in an alkaline processing composition (processing element) or in a proper layer of a light-sensitive element. Examples of developing agents usable in the present invention include hydroquinone, aminophenols (e.g., N-methylaminophenol), 1-phenyl-3-pyrazolidone, 1-phenyl-4,4-dimethyl-3-pyrazolidone, 1-phenyl-4-methyl-4-hydroxymethyl-3-pyrazolidone, N,N-diethyl-p-phenylenediamine, 3-methyl-N,N-diethyl-p-phenylenediamine, 3-methoxy-N-ethoxy-p-phenylenediamine, etc. Of these, black-and-white developing agents which generally decrease formation of stain in the mordant layer are particularly preferable.

When a direct reversal emulsion is used as the light-sensitive silver halide emulsion, a positive image can be directly obtained by developing in the presence of a fogging agent after imagewise exposure. It is also possible to obtain a direct image in the manner described in U.S. Pat. No. 2,456,953 (granted to Knott and Stevens), by uniformly exposing, after imagewise exposure, during surface development processing (high illumination-short time (shorter than $10^{-2}$ second) exposure or low illumination-long time exposure) to cause fogging. The use of a fogging agent is preferable in that fogging degree can be easily controlled. The fogging agent may be incorporated in a light-sensitive material or may be added to a developer, with the former being preferable. Typical examples of this type fogging agent are hydrazines described in U.S. Pat. Nos. 2,588,982 and 2,568,785, hydrazides and hydrazones described in U.S. Pat. No. 3,227,552, and quaternary salt compounds described in British Pat. No. 1,283,835, Japanese Patent Publication No. 38164/74, U.S. Pat. Nos. 3,734,738, 3,719,494, 3,615,615, etc.

Further, transferred positive images can also be obtained according to the DIR reversal emulsion process as described in U.S. Pat. Nos. 3,227,551, 3,227,554, and 3,364,022 or according to the reversal emulsion process utilizing dissolution physical phenomenon as described in British Pat. No. 904,364. U.S. Pat. Nos. 3,227,550 and 3,227,552, British Pat. No. 1,330,524, etc., describe a series of processes for obtaining color diffusion transferred images.

Examples of color-developing agents to be used in using diffusible dye-releasing couplers (DDR couplers) include p-phenylenediamine derivatives described in U.S. Pat. Nos. 3,227,552, 2,559,643 and 3,813,244. Further, p-aminophenol derivatives as described in Japanese Patent Application (OPI) No. 26134/73 are also advantageously used (the term "OPI" as used herein refers to a "published unexamined Japanese patent application").

In the mordant layer to be used in the present invention, mordants such as poly-4-vinylpyridine-latex (particularly in polyvinyl alcohol) described in U.S. Pat. No. 3,148,061, polyvinyl pyrrolidone described in U.S. Pat. No. 3,003,872, and quaternary ammonium salt or phosphonium salt-containing polymers as described in U.S. Pat. Nos. 3,239,337, 3,547,649, 3,709,690, 3,958,995, 3,770,439, 3,898,088, West German Patent Application (OLS) No. 2,264,073 are advantageously used. Further, basic polymers described in, for example, U.S. Pat. Nos. 2,882,156, 3,625,694 and 3,709,690 are also effective as mordants. In addition, mordants described in U.S. Pat. Nos. 2,484,430, 3,958,995, 3,271,147, 3,184,309, 3,271,147, 4,124,386, 3,958,995, 4,154,615, 4,142,899, 4,186,014, 4,080,346, 4,131,469, 4,147,548, 4,124,388, 4,193,795, 4,168,976, 4,206,279, 4,201,840, Japanese Patent Application (OPI) Nos. 126027/79, 145529/79, British Pat. Nos. 2,018,452, 2,042,751A, 2,042,752A, etc., are also effective.

The photographic recording material of the present invention has a support which does not undergo serious dimensional change during photographic processing. Examples of such supports include cellulose acetate film, polystyrene film, polyethylene terephthalate film, polycarbonate film, etc. Further, paper and paper laminated with a water-impermeable polymer such as polyethylene are also effective as supports.

Examples of preferable acidic substances constituting a neutralizing layer to be used in the present invention are described in U.S. Pat. Nos. 2,983,606, 2,584,030, 3,362,819, 3,765,885, 3,819,371 and French Pat. No. 2,290,699. More specifically, useful acidic substances include polymethacrylic acid, acrylic acid-methacrylic acid copolymer (with various copolymerization ratios), copolymers of acrylic acid or methacrylic acid with other vinyl monomer (e.g., acrylic ester, methacrylic ester, vinyl ether, acrylamide, methacrylamide, etc.) (with various copolymerization ratios; preferably 50 to 90 mol% in acrylic acid or methacrylic acid content). Particularly, the use of polyacrylic acid or acrylic acid-butyl acrylate copolymer is recommended. The neutralizing layer can contain, in addition to these acidic substances, such polymers as cellulose nitrate or polyvinyl acetate, or, as is described in U.S. Pat. No. 3,557,237, it can contain a plasticizer. The acidic substance may be microencapsulated to incorporate it in a film unit as described in German Patent Application (OLS) No. 2,038,254.

In the photographic recording material of the present invention, it is preferable to provide a timing layer between the neutralizing layer and the silver halide light-sensitive emulsion layer for obtaining image with a necessary and enough photographic density after exposure and spreading of a processing solution.

Examples of the timing layer which comprises a mixture of cellulose acetate and maleic anhydride copolymer are described in U.S. Pat. Nos. 4,029,849 and 4,056,394. Those comprised of a homo- or copolymer of hydroxyethyl methacrylate or acrylate are described in Japanese Patent Publication No. 46496/77. Preferred timing layers described in U.S. Pat. Nos. 3,421,893, 4,056,394, 4,199,362, 4,201,587, 4,229,516 or British Pat. No. 2,038,493A may be used alone or by superimposing on the above-described timing layer. In addition, timing layers described in U.S. Pat. No. 4,148,653 and German Patent Application (OLS) No. 2,910,271 may also be used, if necessary.

The alkaline processing composition used in the present invention is a liquid composition containing processing components necessary for the development of a silver halide emulsion and necessary for the formation of a diffusion transferred dye image. The main solvent therein is water and, in some cases, a hydrophilic solvent such as methanol or methyl cellosolve is further contained. The processing composition contains alkali in a sufficient amount to maintain the pH at a level necessary for causing development of the emulsion layer and neutralize acids (e.g., hydrohalogenic acid such as hydrobromic acid, carboxylic acid such as acetic acid, and the like) to be produced during various steps for development and dye image formation. Examples of useful alkali materials include alkali metal salts or alkaline earth metal salts such as lithium hydroxide, sodium hydroxide, potassium hydroxide, calcium hydroxide dispersion, tetramethylammonium hydroxide, sodium carbonate, trisodium phosphate, amines such as diethylamine, etc. The processing composition preferably contains a caustic alkali in such concentration that the pH becomes not less than about 10, particularly not less than 12, at room temperature. More preferably, the processing composition contains a hydrophilic polymer such as high molecular polyvinyl alcohol, hydroxyethyl cellulose, sodium carboxymethyl cellulose or the like. These polymers impart to the processing composition a viscosity of not less than 1 poise, preferably from about several hundreds (500 to 600) to about 1,000 poise, at room temperature. This not only facilitates uniform spreading of the composition upon processing but also (upon concentration of the processing composition due to the migration of the aqueous solvent into the photographic recording material in the course of the processing) causes the formation of a non-flowing film. This serves to utitize the film unit after processing. In addition, this polymer film can serve, after the substantial completion of the formation of diffusion transferred dye image, to control further migration of the coloring ingredients into the image-receiving layer, thereby preventing the image from being changed.

In some cases, the processing composition advantageously contains a light absorbent such as $TiO_2$, carbon black, pH-indicating dye, etc., and a desensitizer as described in U.S. Pat. No. 3,579,333 so as to prevent the silver halide emulsion from being fogged by the lights from outside during processing. In addition, a development restrainer such as benzotriazole may be added to the processing composition.

The processing composition to be used in the present invention is advantageously retained in a rupturable container as described in U.S. Pat. Nos. 2,543,181, 2,643,886, 2,653,732, 2,723,051, 3,056,491, 3,056,492, 3,152,515, etc.

The light-sensitive emulsion layer or other hydrophilic colloidal layers in the photographic recording material of the present invention can contain a dispersion of water-insoluble or slightly soluble synthetic polymer for the purpose of improving dimensional stability or the like. For example, there can be used polymers containing as monomer components, alone or in combination, alkyl acrylate or methacrylate, alkoxyalkyl acrylate or methacrylate, glycidyl acrylate or methacrylate, acrylamide or methacrylamide, vinyl ester (e.g., vinyl acetate), acrylonitrile, olefin, styrene, etc., or a combination of the above-described compound and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, or the like. For example, those described in U.S. Pat. Nos. 2,376,005, 2,739,137, 2,953,457, 3,062,674, 3,411,911, 3,488,708, 3,525,620, 3,607,290, 3,635,715, 3,645,740, British Pat. Nos. 1,186,699 and 1,307,373 can be used.

The light-sensitive emulsion layer or other hydrophilic colloidal layer in the photographic recording material of the present invention may contain surfactants for various purposes such as facilitating coating, preventing electrostatic charge, improving sliding properties, facilitating emulsification and dispersion, preventing adhesion, and improving photographic properties (for example, acceleration of development, imparting contrasty tone, sensitization, etc.).

For example, there can be used nonionic surfactants such as saponin (steroid type), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamine or amides, silicone polyethylene oxide adducts, etc.), glycidol derivatives (e.g., alkenylsuccinic acid polyglyceride, alkylphenol polyglyceride, etc.), polyhydric alcohol fatty acid esters, sugar alkyl esters, etc.; anionic surfactants having acidic groups such as carboxy group, sulfo group, phospho group, sulfuric ester group, phosphoric ester group, etc., for example, alkylcarboxylic salts, alkylsulfonates, alkylbenzenesulfonates, alkylnaphthalenesulfonates, alkylsulfates, alkylphosphates, N-acyl-N-alkyltaurines, sulfosuccinic esters, sulfoalkylpolyoxyethylene alkylphenyl ethers, polyoxyethylene alkylphosphates, etc.; amphoteric surfactants such as amino acids, aminoalkylsulfonates, aminoalkylsulfates or phosphates, alkylbetaines, amine oxides, etc.; and cationic surfactants such as alkylamine salts, aliphatic or aromatic quaternary ammonium salts, hetero ring quaternary ammonium salts (e.g., pyridinium, imidazolium, etc.), and phosphonium or sulfonium salts containing an aliphatic or hetero ring.

In the photographic recording material of the present invention, the light-sensitive emulsion layer and other layers can be coated on a support according to various known coating methods. Examples of these coating methods include a dip-coating method, roller-coating method, curtain-coating method and an extrusion-coating method. These processes are described in U.S. Pat. Nos. 2,681,294, 2,761,791 and 3,526,528 and are advantageous.

REFERENCE EXAMPLE a

A mixture of nickel nitrate (0.2 mmol), illustrative Compound (I-1) (0.44 mmol), and a polymer latex of the following structure synthesized according to U.S. Pat. No. 3,958,995 (corresponding to 4.4 mmols in terms of nitrogen atom):

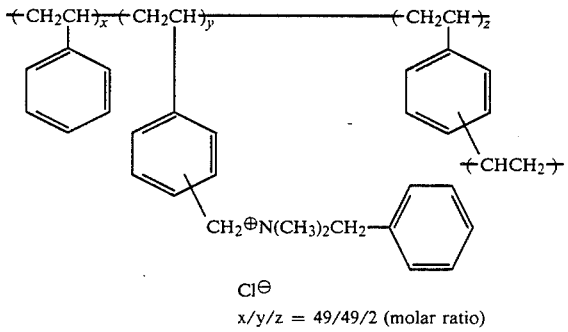

was diluted with water to make the total amount 80 ml. After adjusting the pH of the mixture to 7 with 1N sodium hydroxide, the total amount was adjusted to 100 ml using a messflask, then the resulting solution was sealed in a cellulose tube, which was dipped in 100 ml of distilled water, followed by sealing the whole system.

REFERENCE EXAMPLE b

The same procedures as described in Reference Example a were conducted except for using nitrilotriacetic acid (hereafter "NTA") (0.24 mmol) (comparative ligand (I)) in place of illustrative Compound (I-1) was used in Reference Example a and changing the amount of polymer latex to 2.4 mmols in terms of nitrogen atom.

REFERENCE EXAMPLE c

The same procedures as in Reference Example b were conducted except for using N-hydroxyethylethylenediamine-N,N',N'-triacetic acid (comparative ligand (II)) in place of nitrilotriacetic acid used in Reference Example b.

Samples prepared in Reference Examples a, b, and c were left for ten days at room temperature, and the $Ni^{2+}$ ion concentration outside the cellulose tube was determined through atomic absorption spectrum to obtain the following results.

TABLE 1

| | | Ligand |
|---|---|---|
| Reference Example a | $4 \times 10^{-6}$ M | Present Invention |
| Reference Example b | $1.0 \times 10^{-3}$ M | Comparison |
| Reference Example c | $9.4 \times 10^{-4}$ M | Comparison |

As is clear from the above results, illustrative Ligand Compound (I-1) of the present invention has a substantially higher nickel ion-retaining ability than comparative ligand (I) or (II).

REFERENCE EXAMPLE d

Immobilization of Ni ion:

An image-receiving element containing illustrative Compound (I-1) and nickel acetate was prepared according to the following formulation. Numerals within the parentheses indicate coating amounts in g/m$^2$.

Image-Receiving Element A:

Gelatin (1.0)

$TiO_2$ (20), gelatin (3.0)

Divinylbenzene/styrene/N-benzyl-N,N-dimethyl-N-vinylbenzylammonium chloride copolymer (polymerization ratio: 1:49.5:49.5) (3.0), illustrative Compound (I-1) (0.74), gelatin (3.0)

Nickel acetate (0.35), gelatin (1.0)

Polyethylene terephthalate

As controls, there were prepared image-receiving element B not containing Compound (I-1), image-receiving element C containing a known metal-chelating agent of NTA in place of Compound (I-1), and image-receiving element D containing a known metal-chelating agent of EDTA in place of Compound (I-1).

Each image-receiving element was dipped for 1 hour in a buffer (pH 7.0) containing 1 mol potassium chloride, and Ni ion contents before and after the dipping procedure were determined by atomic absorptiometry. Results thus obtained are shown in Table 2.

TABLE 2

| Image-Receiving Element | Ni Content before Dipping (mmol/m$^2$) | Ni Content after Dipping (mmol/m$^2$) |
|---|---|---|
| A | 1.00 | 0.96 |
| B | 1.01 | 0.01 |
| C | 1.01 | 0.02 |
| D | 1.02 | 0.01 |

The above-described data reveal that migration of Ni ion was not prevented in the metal-chelating agent-free image-receiving element or the image-receiving element containing the known low molecular chelating agent of NTA. In contrast, the image-receiving element containing the compound to be used in the present invention scarcely permitted migration of Ni ion.

REFERENCE EXAMPLE e

Coating film D comprising a transparent film support having coated thereon the following layers was prepared.

(1) A layer containing 3 g/m$^2$ of gelatin and 0.48 g/m$^2$ of Compound (I) of the following structural formula:

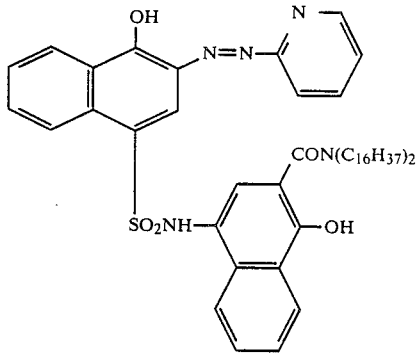

(I)

and formed by dissolving Compound (I) in 0.24 g/m$^2$ of triphenyl phosphate, then dispersing in gelatin. (2) An overcoating layer containing 0.08 g/m$^2$ of gelatin and 2.0 wt% of bis-vinylsulfonylmethyl ether.

Then, coating film D was superimposed, in a swollen state, on image-receiving element A or B obtained in Reference Example d and, after leaving for 10 minutes, film D was delaminated therefrom, dipped in a buffer having a pH of 5.0 and dried to measure its absorption spectrum.

When coating film D was superimposed on image-receiving element B, hue of the coating film changed from yellow to red, thus chelation of Compound (I) in the coating film with nickel having migrated from the image-receiving element being shown.

In contrast, when superimposed on image-receiving element A, the hue of the coating film did not change at all.

Table 3 shows nickel-chelating ratio of Compound (I) in the coating film obtained by analysis of absorption spectrum.

TABLE 3

| Image-Receiving Element | Ni-Chelating Ratio of Compound in Coating Film D |
|---|---|
| A | 0% |
| B | 100% |

REFERENCE EXAMPLE f

Coating film F described below was superimposed on image-receiving element A, B or C obtained in Reference Example d, or on image-receiving element E, the same as image-receiving element A except for not containing nickel acetate, and a viscous solution containing 20 ml of 5N KOH and 5.8 g of carboxymethyl cellulose per 100 g was spread therebetween.

Coating Film F:

Prepared by providing on a polyethylene terephthalate film support the following:

(1) a polyacrylic acid-containing neutralizing layer;

(2) a timing layer composed of a mixture of cellulose acetate and styrene-maleic anhydride copolymer; and (3) a dispersion of a chelatable dye of the following structure in gelatin.

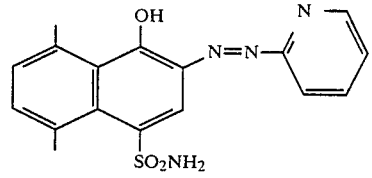

Absorption spectrum of dye transferred to the image-receiving layer was measured versus time using a reflection type spectrophotometer.

With image-receiving element E not containing nickel ion, a maximum absorption was shown at 524 nm after 3 minutes (pH being still high). After 24 hours, the pH value decreased to a value between 4 and 5, with a maximum absorption at 500 nm.

In contrast, with image-receiving elements A, B and C, maximum absorptions were observed at 548 nm and 586 nm after 3 minutes and, after 24 hours, at 530 nm and 564 nm, which were distinctly different from that with image-receiving element E.

This shows that, with image-receiving elements A, B and C, metal ions were bound to the transferred dye.

REFERENCE EXAMPLE g

Coating film F obtained in Reference Example f was superimposed on image-receiving element A, B or C in Reference Example d, or on image-receiving element E in Reference Example f, and a 1N alkaline solution containing carboxymethyl cellulose as a thickening agent was spread between the superimposed layers.

Diffusion of the dye into the mordant layer was determined versus time by measuring reflection density to green light. The results obtained are tabulated in Table 4.

TABLE 4

| Image-Receiving Element | Time | | | |
|---|---|---|---|---|
| | 30 Sec | 60 Sec | 120 Sec | 60 Min |
| A | 0.51 | 0.73 | 0.84 | 0.90 |
| B | 0.24 | 0.49 | 0.73 | 0.91 |
| C | 0.14 | 0.28 | 0.44 | 0.64 |
| D | 0.28 | 0.50 | 0.68 | 0.82 |

The above results show that Ni was in a movable state (Reference Example d).

With image-receiving elements B and C, diffusion of the dye was seriously inhibited.

In contrast, image-receiving element A containing Compound (I-1) to be used in the present invention showed improved diffusion of the dye.

REFERENCE EXAMPLE h

Image-receiving elements A and E, each superimposed on coating film F with a viscous alkaline solution spread therebetween as in Reference Example g, were left for one day, then subjected to a fading test for one week with an illuminance of 17,000 lux to measure stability to light. The results obtained are shown in Table 5.

TABLE 5

| Image-Receiving Element | Ratio of Dye Remaining after 1 Week |
|---|---|
| A | 100% |
| E (no metal ion) | 20% |

The results given in Table 5 show that incorporation of nickel together with Compound (I-1) to be used in the present invention leads to complexing with metal ion as shown in Reference Example g, and serves to greatly improve light stability.

EXAMPLE 1

On the same image-receiving element as image-receiving element A or B in Reference Example d except for omitting the uppermost gelatin layer and containing copper sulfate in place of nickel acetate were coated the following layers.

(1) A radiation barrier layer containing 0.75 g/m$^2$ of gelatin and 1.5 g/m$^2$ of carbon black.

(2) A dye-containing layer containing 1 g/m$^2$ of gelatin and 0.8 g/m$^2$ of the compound represented by the following structural formula, formed by dissolving this compound in 0.1 g/m$^2$ of trihexyl phosphate and dispersing the solution in gelatin.

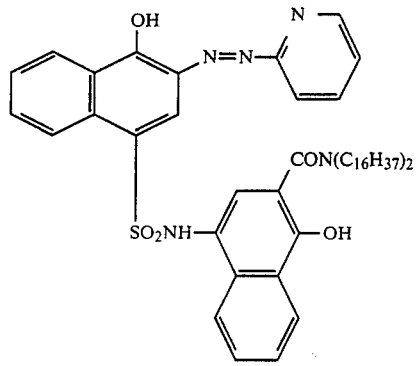

(3) A light-sensitive layer containing 1.9 g/m$^2$ of an internal latent image-forming emulsion, 0.022 g/m$^2$ of 2-methyl-3-(2-formylethyl)benzothiazolium bromide, 2.0 g/m$^2$ of gelatin, and 0.12 g/m$^2$ of 5-octadecylhydroquinone-2-sulfonic acid.

(4) An overcoating layer containing 2 g/m$^2$ of gelatin.

Light-sensitive element A' prepared from image-receiving element A and light-sensitive element B' prepared from image-receiving element B were exposed, each then superimposed on the same coating film (hereinafter referred to as cover sheet) as coating film F in Reference Example f except that it did not contain any dyes. Then, a processing composition of the following formulation was spread therebetween, followed by sensitometry after one hour. The results obtained are shown in Table 6.

TABLE 6

| Light-Sensitive Element | $D_{min}$ | $D_{max}$ | |
|---|---|---|---|
| A' | 0.05 | 2.01 | Present Invention |
| B' | 0.04 | 0.18 | Comparison |

Light-sensitive element B' not containing Compound (I-1) produced harmful sensitometry results. In contrast, light-sensitive element A' of the present invention (containing Compound (I-1)) produced no harmful sensitometry results.

Processing Composition:

| | |
|---|---|
| KOH (28%) | 71 g |
| $Na_2SO_3$ | 2.0 g |
| 5-Methylbenzotriazole | 3.0 g |
| 4-Hydroxymethyl-4-methyl-1-phenyl-3-pyrazolidone | 5.0 g |
| KBr | 20 g |
| Carboxymethyl cellulose | 44 g |
| Water to make | 1 liter |

EXAMPLE 2

Light-sensitive elements C, D and E, the same as light-sensitive element A' in Example 1 except for containing Compound (I-2), (I-5) or (I-94) as the illustrative compound and containing nickel acetate in place of copper sulfate, and light-sensitive element F, the same as these light-sensitive elements except for containing no illustrative compounds, were prepared, and processed by spreading the processing composition as in Example 1 in an unexposed state to measure reflection density of transferred dye to green light at regular time intervals.

TABLE 7

| Light-Sensitive Element | Time 30 Sec. | 60 Sec. | 120 Sec. | 60 Min. | |
|---|---|---|---|---|---|
| C | 0.72 | 1.22 | 1.52 | 1.62 | Present Invention |
| D | 0.65 | 1.10 | 1.48 | 1.60 | " |
| E | 0.70 | 1.20 | 1.50 | 1.61 | " |
| F | 0.38 | 0.70 | 1.20 | 1.50 | Comparison |

In comparison with light-sensitive element F containing no illustrative compounds and therefore permitting Ni to move, light-sensitive elements C, D and E wherein Ni was immobilized in image-receiving elements with illustrative Compounds (I-2), (I-5) and (I-94) allowed the dye to transfer rapidly.

EXAMPLE 3

93 ml of an aqueous solution containing 0.6% illustrative Compound (I-1) was added to 45 g of a 10% gelatin aqueous solution, then 3 ml of a 0.5M nickel acetate solution was added thereto. Color of the solution changed from green (color of nickel acetate) to blue, thus complex formation being observed. To this solution was added an aqueous solution containing 4.5 g of divinylbenzene/styrene/benzyl-N,N-dimethyl-N-vinylbenzylammonium chloride copolymer (weight ratio=1:49.5:49.5), followed by adding thereto sodium hydroxide to adjust the pH to 6.5 and water to make the total weight 150 g.

The above-described composition was coated on polyethylene terephthalate in an amount of 100 g/m$^2$. Then, a light-reflecting layer containing 20 g/m$^2$ of $TiO_2$ and 3 g/m$^2$ of gelatin, a radiation barrier layer containing 0.75 g/m$^2$ of gelatin and 1.5 g/m$^2$ of carbon black, the same dye-containing layer, the same light-sensitive layer, and the same overcoating layer as in Example 1 were coated, in sequence, thereon to prepare light-sensitive element G. As a control, light-sensitive element H, the same as light-sensitive element G except for not containing illustrative Compound (I-1), was prepared.

These light-sensitive elements G and H were spread-processed in the same manner as in Example 2, and transferred dye density was measured at regular intervals.

TABLE 8

| Light-Sensitive Element | Time 30 Sec. | 60 Sec. | 120 Sec. | 60 Min. | |
|---|---|---|---|---|---|
| G | 0.80 | 1.25 | 1.55 | 1.61 | Present Invention |
| H | 0.40 | 0.75 | 1.22 | 1.55 | Comparison |

In comparison with light-sensitive element F (control) wherein Ni was movable, light-sensitive element G containing illustrative Compound (I-1) was observed to allow dye to transfer rapidly.

When reflection spectrum of sample G was measured 60 minutes after spreading the processing composition, maximum absorptions were shown at 530 nm and 564 nm. Thus, transferred dye was confirmed to form an Ni chelate.

EXAMPLE 4

Light-sensitive element J, the same as light-sensitive element G except for containing the following compound in the mordant-containing layer and containing Copound (I-56) in place of Compound (I-1), and light-sensitive element K, the same as light-sensitive element J except for containing a known chelating agent of NTA in place of illustrative Compound (I-1), were prepared.

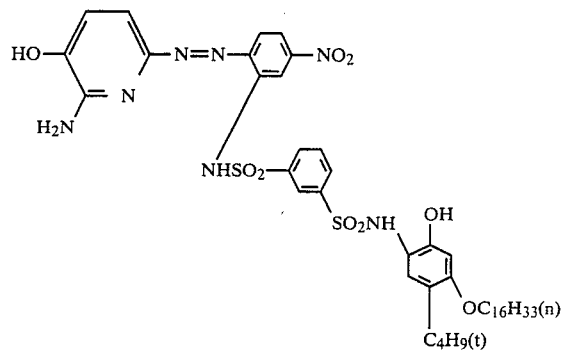

These were spread-processed in the same manner as in Example 3, and reflection density of the transferred dye to red light was measured at regular intervals.

TABLE 9

| Light-Sensitive Element | Time 30 Sec. | 60 Sec. | 120 Sec. | 60 Min. | |
|---|---|---|---|---|---|
| J | 0.26 | 0.80 | 1.30 | 1.60 | Present Invention |
| K | 0.16 | 0.55 | 1.06 | 1.40 | Comparison |

In comparison with NTA-containing light-sensitive element K which had been shown in Reference Example d to allow Ni to move, Compound (I-1)-containing light-sensitive element J which had been shown also in Reference Example d to well immobilize Ni in image-receiving layer showed rapid dye transfer.

While the invention has been described in detail and with reference to specific embodiments thereof, it will be apparent to one skilled in the art that various changes and modifications can be made therein without departing from the spirit and scope thereof.

What is claimed is:

1. A photographic recording material comprising a support having thereon at least a mordant layer, said mordant layer or a layer superposed on said support and in close proximity to the mordant layer containing a coordinate polymer composed of a ligand represented by the following general formula (I) and a metal ion;

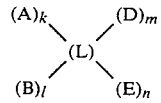

(I)

wherein A, B, D and E, which may be the same or different, each represents a coordinating group selected from the group consisting of:

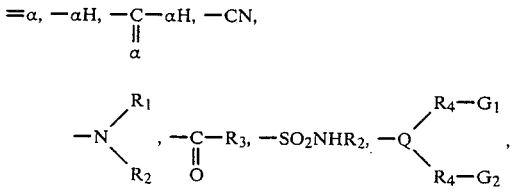

-continued

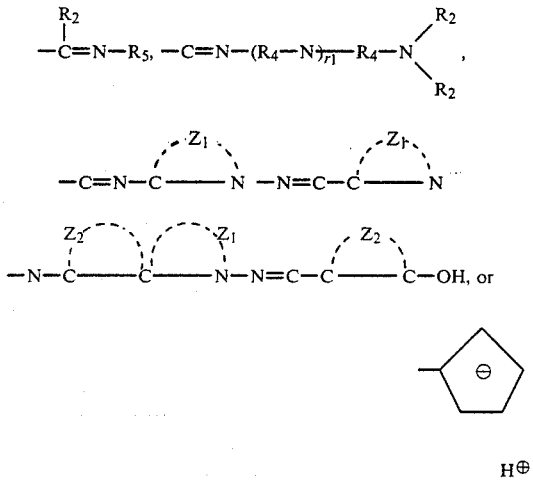

wherein $\alpha$ represents O or S, $R_1$ represents $R_2$ or —CONH—$R_2$, —$SO_2R_6$ or —$SO_2NHR_6$, $R_2$ represents a hydrogen atom or an alkyl group containing 1 to 6 carbon atoms, $R_3$ represents $R_2$ or —$CH_2COR_5$, $R_4$ represents an alkylene group containing 1 to 4 carbon atoms, $R_5$ represents —OH or $R_6$, $R_6$ represents an alkyl group containing 1 to 6 carbon atoms or an aryl group containing 6 to 10 carbon atoms, Q represents N, P or As, $G_1$ and $G_2$ each represents $$-\underset{\alpha}{\underset{\|}{C}}-\alpha\text{-H},\ -CN,\ -\underset{O}{\underset{\|}{P}}(OH)_2,\ -\underset{O}{\underset{\|}{P}}-OH \text{ or } -\underset{O}{\underset{\|}{C}}-NHOH,$$

$r_1$ represents an integer of 0 to 4, $Z_1$ represents atoms necessary for forming at least one 5- to 7-membered hetero ring, and $Z_2$ represents $Z_1$ or atoms necessary for forming at least one 5- to 7-membered carbon ring, L represents phenyl, naphthalene, biphenyl, —$CH_2$-$Z_4$—$CH_2$—, or —$CH_2)_{r4}Z_4$—$Y_2$—$Z_4$—$CH_2)_{r4}$, wherein $Z_4$ represents phenylene or naphthalene, $Y_2$ represents —O—, —CONH—, —$SO_2NH$—, —CO— or —$SO_2$—, and $r_4$ represents 0 or 1 and having a valency of (k+l+m+n), and k, l, m and n each represents an integer of 0 to 6, with k+l+m+n being 2 to 10.

2. A photographic recording material comprising a support having thereon at least a mordant layer, said mordant layer or a layer superposed on said support and in close proximity to the mordant layer containing a coordinate polymer composed of a ligand represented by the following general formula (I) and a metal ion;

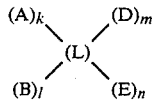

(I)

wherein A, B, D and E, which may be the same or different, each represents a coordinating group selected from the group consisting of:

$$=\alpha,\ -\alpha H,\ -\underset{\alpha}{\underset{\|}{C}}-\alpha H,\ -CN,$$

-continued

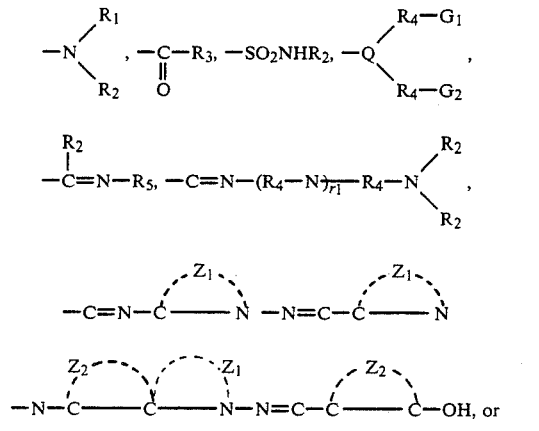

wherein $\alpha$ represents O or S, $R_1$ represents $R_2$ or —CONH—$R_2$, —$SO_2R_6$ or —$SO_2NHR_6$, $R_2$ represents a hydrogen atom or an alkyl group containing 1 to 6 carbon atoms, $R_3$ represents $R_2$ or —$CH_2COR_5$, $R_4$ represents an alkylene group containing 1 to 4 carbon atoms, $R_5$ represents —OH or $R_6$, $R_6$ represents an alkyl group containing 1 to 6 carbon atoms or an aryl group containing 6 to 10 carbon atoms, Q represents N, P or As, $G_1$ and $G_2$ each represents $$-\underset{\alpha}{\underset{\|}{C}}-\alpha\text{-H},\ -CN,\ -\underset{O}{\underset{\|}{P}}(OH)_2,\ -\underset{O}{\underset{\|}{P}}-OH \text{ or } -\underset{O}{\underset{\|}{C}}-NHOH,$$

$r_1$ represents an integer of 0 to 4, $Z_1$ represents atoms necessary for forming at least one 5- to 7-membered hetero ring, and $Z_2$ represents $Z_1$ or atoms necessary for forming at least one 5- to 7-membered carbon rings, L represents a chain or alicyclic hydrocarbon residue containing 3 to 20 carbon atoms, $-(CH_2)_{r2}Z_3-$, $-(CH_2)_{r2}Z_3-(CH_2)_{r2}$, $-(CH_2)_{r3}Z_3-(CH_2)_{r2}Z_3-(CH_2)_{r3}$ and $-(CH_2)_{r3}Z_3-(Y-Z_3)_{r3}Y-Z_3-(CH_2)_{r3}$ wherein $Z_3$ represents an aromatic hydrocarbon residue containing 3 to 18 carbon atoms or a hetero ring residue, $r_2$ represents an integer of 1 to 4, $r_3$ represents 0 or $r_2$, Y represents $$-O-,\ -S-,\ -NR_8-,\ -CONR_8-,\ -SO_2NR_8-,\ -COO-,$$

$$-CO-,\ -SO_2-,\ -\underset{O}{\underset{\|}{NHC}}-NH-,\ -NHSO_2-NH- \text{ or}$$

$$-CH=CH-CH_2)_{r3}-,$$

$R_8$ represents a hydrogen atom or $R_7$ wherein $R_7$ represents an alkyl group containing 1 to 6 carbon atoms, or an aryl group containing 6 to 10 carbon atoms, provided that when all of the coordinating groups are only

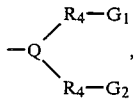

L does not represent a chain hydrocarbon residue containing 1 to 3 carbon atoms, and k, l, m and n each represents a integer of 0 to 6, with k+l+m+n being 2 to 10.

3. A photographic recording material as claimed in any one of claims 1 and 2, wherein A, B, D and E, each represents a coordinating group

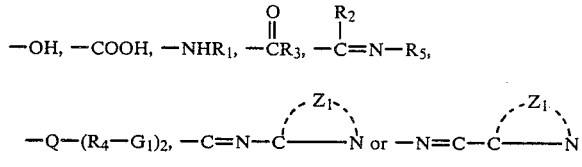

where $R_1$, $R_2$, $R_3$, $R_4$, $R_5$, Q, $G_1$ and $Z_1$ has the same meanings as defined above.

4. A photographic recording material as claimed in any one of claims 1 and 2, wherein A, B, D and E each represents a coordinating group —OH, —COOH, $—NH_2$ or $—N(CH_2—G_1)_2$ where $G_1$ has the same meanings as defined above.

5. A photographic recording material as claimed in claim 2, wherein L represents an aromatic hydrocarbon residue containing 3 to 18 carbon atoms or a hetero ring residue, $—CH_2)_{r2}Z_3—CH_2)_{r2}$ or $(CH_2)_{r4}Z_3Y—Z_3(CH_2)_{r4}$ wherein $Z_3$ represents an aromatic hydrocarbon residue containing 3 to 18 carbon atoms or a hetero ring residue, $r_2$ represents an integer of 1 to 4, Y represents

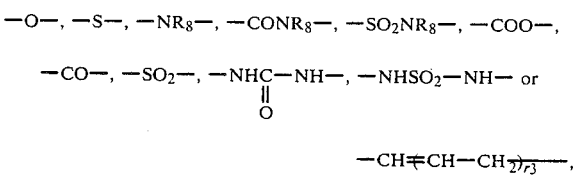

$R_8$ represents a hydrogen atom or $R_7$ wherein $R_7$ represents an alkyl group containing 1 to 6 carbon atoms, or an aryl group containing 6 to 10 carbon atoms, $r_3$ represents 0 or $r_2$ and $r_4$ represents 0 or 1.

6. A photographic recording material as claimed in any one of claims 1 and 2, wherein m=n=0 and k+l=2 to 6.

7. A photographic recording material as claimed in any one of claims 1, and 2, wherein said metal ion is copper (II), zinc, (II), nickel (II), platinum (II), palladium (II) or cobalt (II).

8. A photographic recording material as claimed in claim 6, wherein said metal ion is copper (II) or nickel (II).

9. A photographic recording material as claimed in any one of claims 1 and 2 wherein said material comprising (I) an integral element comprising:

(1) a transparent support having thereon (a) a dye mordanting layer, (b) an alkali permeable light reflecting layer (c) an alkali permeable opaque layer, (d) a red-sensitive silver halide emulsion layer containing a ballasted cyan dye releaser, (e) a green-sensitive silver halide emulsion layer containing a ballasted magenta dye releaser, and (f) a blue-sensitive silver halide emulsion layer containing a ballasted yellow dye releaser, in this order (2) a transparent sheet comprising a transparent support having thereon a neutralizing layer and a timing layer in this order, said transparent sheet being superimposed over said blue-sensitive silver halide emulsion layer, and (3) a rupturable container capable of bearing an alkaline processing composition and an opacity imparting agent, said container being positioned such that the content thereof can be released between said transparent sheet and said blue-sensitive silver halide emulsion layer due to compression force applied to said container during processing, and (II) a developing agent for silver halide.

10. A photographic recording material as claimed in claim 9, wherein said metal ion is contained in said dye mordanting layer or a layer adjacent thereto.

11. A photographic recording material as claimed in claim 10, wherein said ligand is present above or in said dye mordanting layer.

12. A photographic recording material as claimed in any one of claims 1 and 2, wherein the coordinate polymer is contained on the material in an amount of 0.05 to 20 $g/m^2$.

13. A photographic recording material as claimed in claim 12, wherein the coordinate polymer is contained in an amount of 0.5 to 5 $g/m^2$.

14. A photographic recording material as claimed in any one of claims 1 and 2, wherein the metal ion is coated on the material in an amount of about $10^{-5}$ to about $10^{-1}$ $mol/m^2$.

15. A photographic recording material as claimed in any one of claim 1 and 2, wherein said material comprises a support base having thereon at least the following layers:

(a) a mordant layer, and (b) at least a light-sensitive silver halide emulsion layer associated with a dye ligand or a dye ligand-forming substance.

16. A photographic recording material as claimed in any one of claims 1 and 2 with the proviso that when k+l+m+n is less than 4, at least two of the coordinating groups represented by A, B, D and E have at least two coordinating atoms capable of forming coordination bonds with a metal atom.

* * * * *